United States Patent [19]

Burian

[11] 4,175,573

[45] Nov. 27, 1979

[54] MANICURE ATTACHMENT

[75] Inventor: Paul D. Burian, Elmsford, N.Y.

[73] Assignee: Clairol Incorporated, New York, N.Y.

[21] Appl. No.: 891,891

[22] Filed: Mar. 30, 1978

[51] Int. Cl.[2] ..... A45D 29/05

[52] U.S. Cl. ..... 132/73.6

[58] Field of Search ..... 132/73.6, 73, 75.3; 64/4

[56] References Cited

U.S. PATENT DOCUMENTS

| | | | |
|---|---|---|---|
| 1,719,063 | 7/1929 | Lidseen | 132/73.6 |
| 1,719,064 | 7/1929 | Lidseen | 132/73.6 |
| 1,988,581 | 1/1935 | Ubelhart et al. | 132/73.6 |
| 2,008,920 | 7/1935 | Moir | 64/4 |
| 2,033,552 | 3/1936 | Schleimer | 132/73.6 |
| 2,131,628 | 9/1938 | Kohl | 132/73.6 |
| 2,239,870 | 4/1941 | Ariza | 132/73.6 |
| 2,880,737 | 4/1959 | Tone et al. | 132/73.6 |

*Primary Examiner*—G. E. McNeill

*Attorney, Agent, or Firm*—Sherman & Shalloway

[57] ABSTRACT

The application discloses an attachment for rotary manicuring units which provides a low-amplitude reciprocation of a cuticle-pushing member. A plurality of teeth or cam points are arranged about the axis of the unit in opposed rings which are biased away from each other by a resilient ring whose bias is overcome by a gentle pushing force of the tip of the pushing member against the cuticle to permit engagement of the opposing cam points and reciprocation of the pusher member. In the preferred form, the cam points are in the form of sharp teeth having a relatively gently sloping cam surface and a sharp drop for quick return of the opposed teeth into mutual engagement. The resilient ring preferably is in the form of a porous ring of synthetic material which is impregnated with a suitable lubricant for the cam points.

8 Claims, 4 Drawing Figures

MANICURE ATTACHMENT

BACKGROUND OF THE INVENTION

The present invention relates to the grooming of nails by manicuring units and is concerned, more particularly, with the grooming of nails by pushing and receding the cuticle of the nail in conjunction with a rotary manicuring unit by an attachment for converting the rotary motion of the unit to a gentle, short-stroke reciprocation of a suitable pusher member.

BRIEF DISCUSSION OF THE PRIOR ART

A variety of attempts have been made to provide effective cuticle pushers or cuticle-pusher attachments which are mountable upon power-driven manicuring units or systems. These have ranged from the familiar orange stick, which is manually pushed against the cuticle, to more complex members which are intended for use with vibratory or rotary power systems.

In view of the trend of the art toward power-driven manicuring units in general and particularly in view of the recent acceptance of portable, battery-operated manicuring units suitable for self-manicure by relatively untrained individuals, a need for a quickly-mountable or changeable cuticle pushers for use with power units has ocurred with the simultaneous requirement that the cuticle pusher be equally facile in use by untrained individuals in order to avoid damage or painful consequences from the use of the pushers in self-manicure.

U.S. Pat. Nos. 1,988,581 to Ubelhart and 2,008,920 to Moir disclose attachments for the conversion of the rotary motion of floor-mounted or table-type power units to provide a reciprocating motion to a cuticle-engaging member.

U.S. Pat. No. 1,988,581 discloses a floor type manicuring system employing a rotating power unit which reciprocates an elongate wire upon which is mounted a handpiece. The handpiece is adapted to receive the shanks of a variety of manicuring implements which are insertable in a recess in the handpiece. The implements include a cuticle-engaging orange stick which is actuable against the cuticle simply by the vibratory motion caused by the reciprocating mass of the tool-engaging slide within the handpiece.

U.S. Pat. No. 2,008,920 discloses a powered manicuring unit in which rotary power is delivered to a handpiece which is employed with a variety of manicuring implements, including rotary abrading units. A conversion unit having an internal cam is also disclosed for converting the rotary power available in the handpiece into a reciprocating motion for use with a cuticle-pushing member. The conversion unit includes a compression spring to maintain positive engagement of the camming surfaces.

These cuticle-engaging systems, however, are suitable only in the large and costly forms of manicuring installations in which they are disclosed. An analogous installation is also disclosed in U.S. Pat. No. 2,033,552 to Schleimer, which employs a diaphragm in a handpiece to effect reciprocation of a cuticle-pushing stick.

With regard to smaller, more convenient forms of manicuring units, it is of interest that cuticle-pusher elements are to be found in vibratory and reciprocating forms of hand-held units. These include U.S. Pat. Nos. 1,719,063 and 1,719,064 to Lidseen, which employ a vibratory drive, and U.S. Pat. No. 2,880,737 to Tone, which employs a worm drive to convert rotary motion into reciprocation for filing and cuticle-pushing attachments.

Most recently, however, the manicuring art has progressed to battery-operated, self-contained manicuring units in which a variety of rotating implements are provided for the filing and polishing of nails by an extremely facile unit which is capable of secure and accurate manipulation in self-manicuring of fingernails and toenails. These units are capable of single-hand manipulation and control and are of small size and light weight to permit such control.

The most advantageous contemporary manicuring unit available is disclosed in an application filed by myself and Arthur T. Sempliner, Ser. No. 683,854, filed May 6, 1976 and titled "MANICURING UNIT." The unit disclosed in the aforementioned application is a compact, battery-driven member which drives large-diameter manicuring elements at low rotational speeds to provide very low working-surface speeds of the large tools to prevent undesireable mishaps such as gouging, scalloping or accidental injury during the use of the unit in self-manicure.

The advantages and facility achieved by such manicure units are such that any attachment intended for cuticle-clearing use must necessarily retain the balance and facility of the unit in order to be successful in their purpose and acceptable to the users for self-manicure.

Accordingly, prior forms of cuticle-pusher units and attachments have not been found to be entirely satisfactory, especially in conjunction with the most recent advances in the art of self-manicure.

SUMMARY OF THE INVENTION

In general, the preferred form of the present invention comprises an attachment for rotary-implement manicuring units including a casing having a mount for securement on the unit and a non-rotating cuticle-pusher element extended from the casing via an aperture which permits reciprocation of the pusher member without permitting substantial rotation of the member. The pusher member includes a ring of cam teeth which are aligned with a complementary ring of cam teeth mounted on a rotary transfer element adapted to engage the rotary output member of the manicuring unit. The opposed rings of cam teeth are biased away from each other by an intermediate ring of compressible material to maintain the rings of cam teeth out of engagement with each other except when longitudinal pressure is applied to the pusher member. Preferably, the compressible intermediate ring is formed of a porous material capable of containing a supply of a suitable lubricant for release between the opposed cam teeth and is confined by retaining members thereabout for restricting the flow of lubricant outwardly from the cam teeth.

OBJECTS OF THE INVENTION

It is an object of the present invention to provide a quickly mountable cuticle-pusher attachment for rotary manicuring units.

It is another object of the present invention to provide a quickly mountable, self-contained cuticle-pusher attachment for rotary manicuring units with means for converting rotary motion to reciprocating motion of a pusher member.

It is another object of the present invention to provide a quickly mountable cuticle-pusher attachment for rotary manicuring units with a self-contained means for converting rotary motion to a reciprocating motion of a pusher member to provide a high frequency, low amplitude reciprocation of the pusher member.

It is a further object of the present invention to provide a cuticle-pusher attachment for rotary manicuring units with self-contained, multiple-cam drive means for converting rotary motion to high frequency, low amplitude reciprocating motion of a pusher member with a biasing member for maintaining a separation of opposed cams until the pusher member is pressed longitudinally inwardly of the attachment by engagement with an object.

A further object of the present invention is the provision of a cuticle-pusher attachment for rotary manicuring units in which opposed, annular series of cam teeth provide reciprocating motion from the rotary motion of the manicuring unit and are biased out of engagement by an annular resilient member of porous material which is impregnated with a lubricant for release to the cam teeth.

BRIEF DESCRIPTION OF THE DRAWINGS

These and other objects of the invention and a better understanding thereof may be derived from the following description and the accompanying drawings, in which.

DETAILED DESCRIPTION OF THE PREFERRED EMBODIMENT

Figure 4:
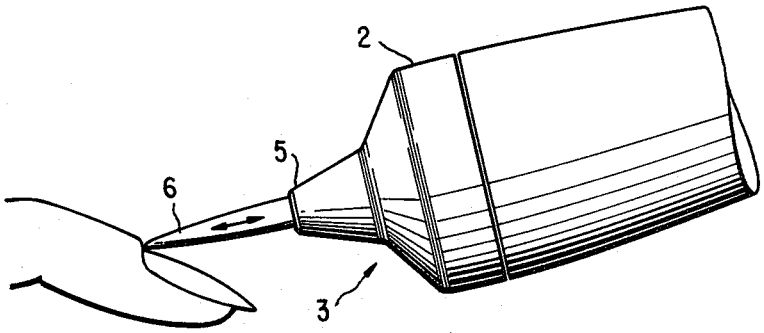
FIG. 4 is a perspective view of the attachment mounted upon a manicuring unit and in use against the cuticle area of a finger.
Figure 1:
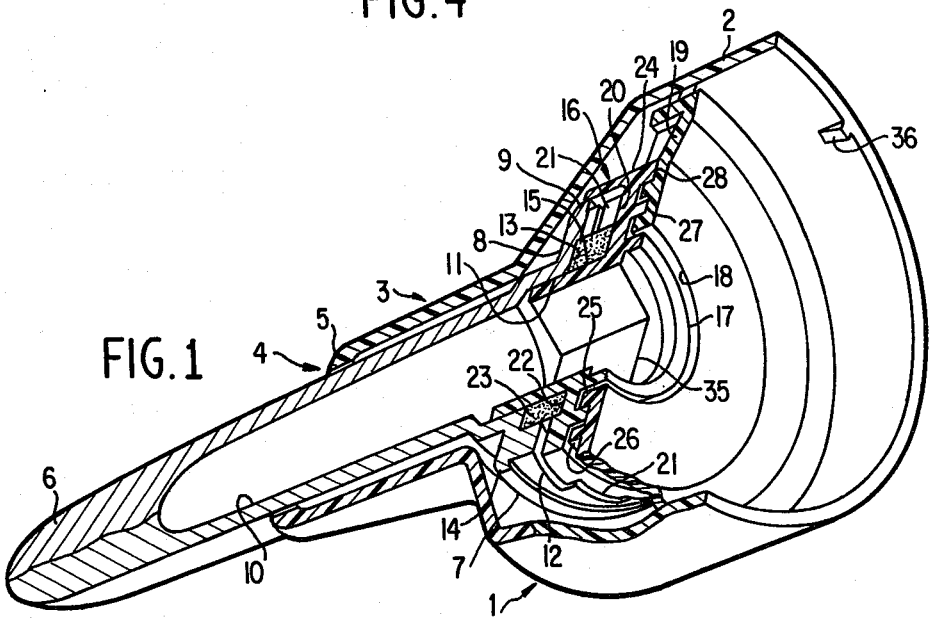
FIG. 1 is a perspective, sectional view of the preferred form of cuticle-pusher attachment.

As shown in the drawings, the preferred form of cuticle-pusher attachment of the present invention is adapted to use with the manicuring unit disclosed in my aforementioned application Ser. No. 683,854. It is to be understood, however, that the pusher attachment is quite capable of use with other rotary manicuring units, with appropriate modifications of the mounting and drive components to accomodate the particular configuration of the manicuring unit with which the attachment is to serve.

The preferred cuticle-pusher attachment includes a casing 1 having a generally cylindrical portion 2 and a tapering anterior portion 3. The anterior portion has an ovate aperture 4 therein at its smaller end portion 5. The aperture 4 receives the ovate main portion of a pusher member 6 relatively loosely therethrough for protrusion externally of the casing. Within the casing, the pusher member includes a transverse flange 7 extended at right angles to the length of the member and the axis of the casing. On its anterior surface 8, the flange is relieved and otherwise suitably configured to permit a slight reciprocation thereof with regard to the casing. A chamfer 9 is used to provide clearance adjacent the forward casing wall.

The interior of the pusher member preferably is hollowed by a bore 10 along a portion of its length and includes a cylindrical bore 11 extending through and forward of the flange 7. The cylindrical bore is positioned centrally with regard to the flange 7.

The rearward surface of the flange 7 carries a plurality of cam teeth or serrations 12 which are symmetrically distributed in a ring concentric with the bore 11 and spaced therefrom to form a flat shoulder 13 on the flange 7 intermediate the bore 11 and the serrations. The flange extends radially outwardly of the ring of serrations to provide a circular outer flange edge 14 at its periphery.

The cylindrical bore 11 loosely receives a cylindrical forward extension 15 of a power transfer member 16 which is rotatably mounted via a rearwardly-extending, cylindrical sleeve 17 which is received in a bearing bore 18 in a transverse bulkhead 19 within the cylindrical portion 2 of the casing. The forward portion 15 and sleeve 17 thus form a composite axle for the power transfer member 16 by their rotary mounting in the cylindrical bore 11 and the bearing bore 18, respectively.

The power transfer member 16 includes a transverse flange 20 carrying a plurality of serrations or driving cam teeth 21 which are symmetrically arranged in a ring concentric with the forward extension 15 and which are complimentary to and opposite the teeth 12 of the pusher flange 7. The transfer member teeth are spaced outwardly on the flange 20 from the forward extension to provide a recess 22 within which is loosely mounted a resilient ring 23 to be discussed more fully hereinafter. The outermost portion of the flange 20 includes a skirt 24 surrounding the serrations and extending forwardly a distance sufficient to lie adjacent the outer flange edge 14 of the pusher member. The outer flange edge 14 and the skirt 24 thus form a circular running joint or closure pair for the chamber formed thereby within the skirt.

On its posterior or rearward surface, the transfer member flange 20 carries a pair of concentric annular ribs 25 and 26 which are radially spaced from each other and from the sleeve 17 and which interfit with annular ribs 27 and 28 on the bulkhead 19 to form a labyrinth seal for preventing the intrusion of foreign material to the interior of the casing via the bearing bore 18.

Figure 2:
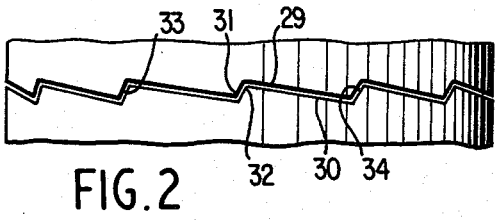
FIG. 2 is a side view, on an enlarged scale, of a portion of FIG. 1 and showing the cam-teeth profile.
Figure 3:
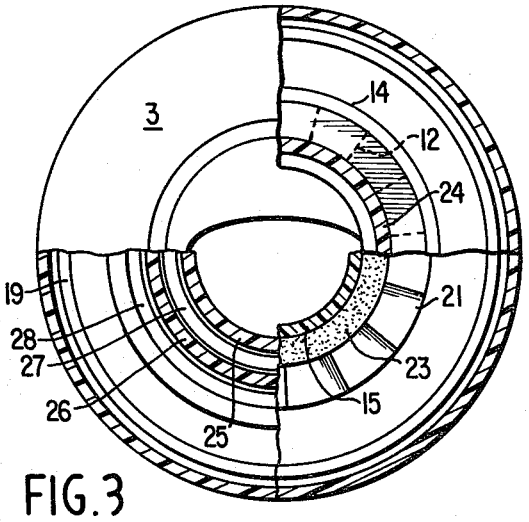
FIG. 3 is an end view, partly cut away, showing the radial relationships of the several moving components of the attachment of FIG. 1.

As best shown in FIG. 2, the preferred form of serrations or cam teeth 12 and 20 include moderately-sloping inclined portions 29 and 30, respectively, which terminate in sharp peaks 31 and 32. The sharp peaks 31 and 32 have steeply-sloping transition surfaces 33 and 34 immediately adjacent thereto to provide for a sudden recession of the camming surface to permit a sudden retraction of the pusher member from the extreme forward point of reciprocation forced by the peaks. It is preferred that the rings of serrations include equal numbers of complementary cam teeth and, although twelve teeth per ring are preferred, a greater or lesser number may be employed, as desired or as may be preferable with the rotational speed of the paticular manicuring unit for which the attachment is intended. It has been found advantageous to have the pusher reciprocate at a rate of about 60 strokes per second at an amplitude of about one millimeter for comfortable recessing of cuticle tissue. If desired, one of the teeth rings may have a lesser number of teeth than the other, as long as they mesh and are symmetrically arranged about the annular zone they occupy.

The resilient ring 23 preferably is formed of a porous synthetic material having open pores which are impregnated with a suitable lubricant for the teeth of the opposed cam rings. The spring "rate" or biasing effect of the material need only be sufficient to maintain separation of the opposed cam rings, in the absence of axial force or pressure upon the pusher member, and preferably is very easily overcome by light pressure of the pusher against cuticle material so that a minimal force is required to "clutch" or initiate the camming action.

In its center, the power transfer member 16 is provided with a hexagonal bore 35 adapted to receive the driving shaft of the preferred rotary manicuring unit. It is to be understood, however, that other types of power couplings may be employed in the power transfer member 16 to accomodate the particular manicuring unit desired. Similarly, the cylindrical portion of the housing carries mounting projections 36 for engagement with portions of the preferred manicuring unit, but different mounting means may be provided as desired.

The attachment unit is assembled by insertion of the pusher member into the casing with the working end protruding throught the aperture 4. The power transfer member, having the resilient ring loosely mounted about the forward extension 15 and against the recess 22, is then inserted until its extension 15 is received in the cylindrical bore of the pusher member. The assembly is then completed by positioning of the bulkhead 19 and securement thereof in the casing by suitable means such as ultrasonic welding.

In use, the cuticle attachment is simply snapped onto the manicuring unit, being retained against rotation thereon by the frictional contact with the housing of the manicuring unit. With the manicuring unit turned on, the power transfer member is rotated by its engagement with the output shaft of the unit.

The pusher member, however, is held in an extended position by the bias of the resilient ring 23, so that the teeth 12 of its flange are out of engagement with the opposite teeth 21 of the rotating power transfer member. Upon the exertion of a slight pressure lengthwise against the pusher member, the resilient ring collapses sufficiently to permit engagement of the opposing teeth, thereby causing rapid, low amplitude reciprocation of the pusher tool against the cuticle. The pusher member is confined against rotation by the engagement of its ovate portion with the ovate aperture 4.

Upon removal of the pusher member from axially-deflecting contact with the cuticle, the bias of the resilient ring again de-clutches or separates the opposed teeth and allows the power transfer member to revolve out of driving engagement with the pusher member.

Therefore, it is apparent that the new cuticle-pusher attachment provides a convenience and facility of mounting and use which is fully compatible with the advantages and requirements of the recent forms of manicuring units and delivers a particularly advantageous, rapid and low-amplitude stroke to the pusher tip.

Various changes may be made in the details of the invention as described without sacrificing the advantages thereof or departing from the scope of the appended claims.

I claim:

1. A cuticle attachment for rotary manicuring units comprising a casing, a power transfer member mounted for rotation in said casing, said power transfer member having a plurality of driving cam teeth arranged symmetrically about the axis of rotation thereof, a pusher member in said casing mounted for reciprocation therein, an aperture in said casing aligned with the axis of reciprocation of said pusher member, a portion of said pusher member being extended through said aperture, said pusher member having a plurality of follower cam teeth arranged opposite said driving cam teeth and symmetrically about the axis of rotation of said power transfer member, biasing means for normally biasing said driving cam teeth and said follower cam teeth axially from each other, means for confining said pusher member against rotation with said power transfer member, and mounting and driving means for mounting said casing on a rotary manicuring unit with the power transfer member in driven engagement therewith.

2. A cuticle attachment as set forth in claim 1 in which at least one of said plurality of driving cam teeth and said plurality of follower cam teeth comprises a ring of cam teeth.

3. A cuticle attachment as set forth in claim 2 in which said biasing means includes a resilient member positioned adjacent said ring of cam teeth.

4. A cuticle attachment as set forth in claim 3 in which said resilient member is formed of an open-pored synthetic material, said resilient member being impregnated with a lubricant.

5. A cuticle attachment as set forth in claim 4 in which said resilient member is a ring positioned coaxially with said ring of cam teeth.

6. A cuticle attachment as set forth in claim 5 and including a skirt on said power transfer member and forming with said pusher member a chamber about said cam teeth and said resilient ring.

7. A cuticle attachment as set forth in claim 6 in which said means for confining said pusher member against rotation includes a non-circular portion in said aperture and a complementary non-circular portion on said extended portion of the pusher member.

8. A cuticle attachment as set forth in claim 7 in which said aperture and said complementary portion of the pusher member are ovate.

* * * * *